US005685175A

United States Patent [19]

Flavin et al.

[11] Patent Number: 5,685,175

[45] Date of Patent: Nov. 11, 1997

[54] THREAD POSITIONER

[76] Inventors: James M. Flavin; Myra E. Flavin, both of 2966 Foxcroft Dr., Tallahassee, Fla. 32308

[21] Appl. No.: 595,297

[22] Filed: Feb. 1, 1996

[51] Int. Cl.[6] ..... D04B 35/00; D05B 87/00

[52] U.S. Cl. ..... 66/1 A; 223/99

[58] Field of Search ..... 66/1 A, 3; 223/99, 223/102; 24/3.13, 12 M, 298, 299, 905

[56] References Cited

U.S. PATENT DOCUMENTS

| | | | |
|---|---|---|---|
| 1,269,660 | 6/1918 | Turner | 24/299 X |
| 1,374,841 | 4/1921 | Finkelstein | 24/12 |
| 2,054,345 | 9/1936 | Van Pelt | 24/299 |
| 2,641,809 | 6/1953 | Kimball | 24/299 X |
| 3,250,447 | 5/1966 | Larew | 223/99 |
| 3,404,707 | 10/1968 | Feld | 223/99 X |
| 3,893,602 | 7/1975 | Ivy | 223/99 |
| 4,422,564 | 12/1983 | Koenig et al. | 223/99 |
| 4,432,120 | 2/1984 | Sherman, Jr. et al. | 24/299 |
| 4,540,108 | 9/1985 | Campbell | 223/102 |
| 4,555,918 | 12/1985 | Cahuzac | 66/119 |
| 4,630,454 | 12/1986 | Seremjian | 66/1 |
| 4,671,437 | 6/1987 | Sauger | 223/103 |
| 4,779,616 | 10/1988 | Johnson | 223/99 X |
| 4,846,351 | 7/1989 | Gardiner | 206/574 |
| 5,038,836 | 8/1991 | Caramaschi | 139/11 |
| 5,163,206 | 11/1992 | Hernandez | 24/299 |

FOREIGN PATENT DOCUMENTS

| | | | |
|---|---|---|---|
| 613431 | 11/1926 | France | 223/99 |
| 85381 | 6/1920 | Switzerland | 223/99 |

*Primary Examiner*—John J. Calvert
*Attorney, Agent, or Firm*—Peter Loffler

[57] ABSTRACT

A thread positioner comprises a guide loop, having a finger grip, that is insertable through one or more stitches of a needlework project. A thread grabber is insertable through the guide loop and grabs a loose thread and is thereafter withdrawn, positioning the loose thread within the guide loop. The guide loop is withdrawn from the stitches positioning the loose thread therewithin.

16 Claims, 1 Drawing Sheet

FIG. 1
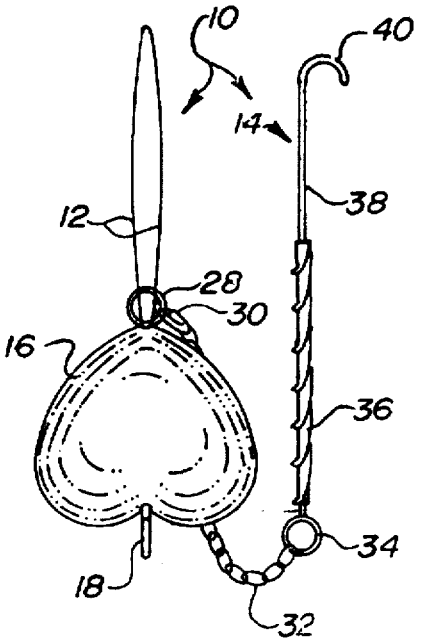
FIG. 2
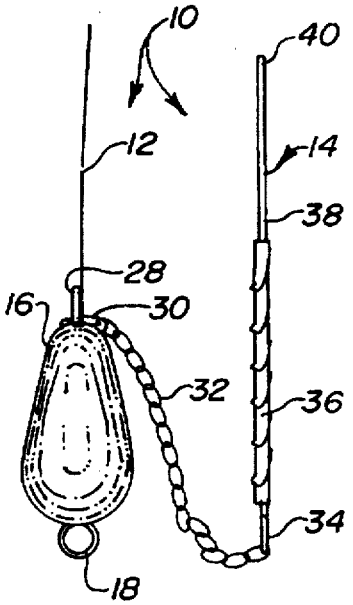
FIG. 3
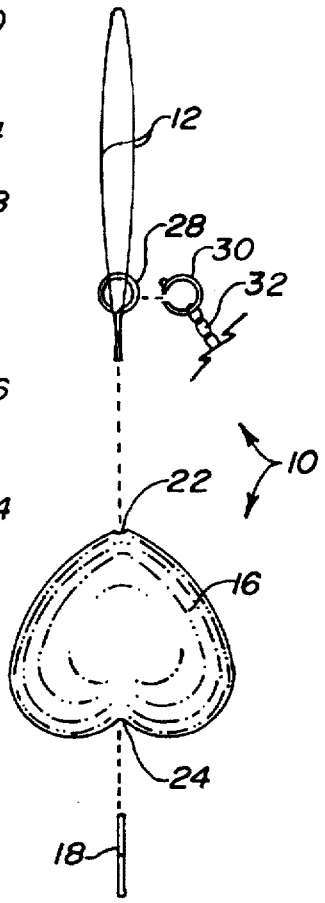
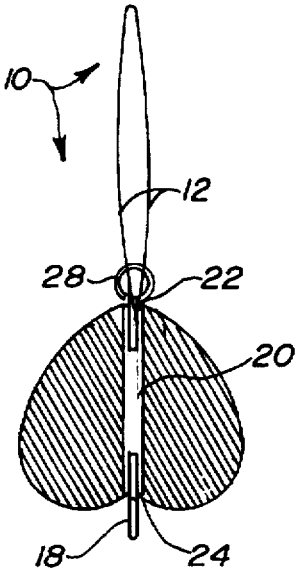
FIG. 4
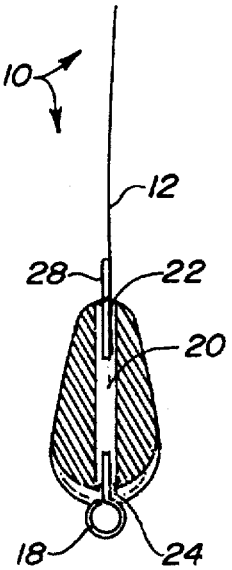
FIG. 5

THREAD POSITIONER

BACKGROUND OF THE INVENTION

1. Field of the Invention

The present invention concerns the knitting and sewing arts and more particularly relates to a unique tool for use in grabbing a loose thread and positioning the thread for securement within the needlework.

2. Background of the Prior Art

Loose threads will invariably appear on the back mesh of any needlework project. Such loose threads result from waste knots, cut out stitches and the like. Such threads, if left unattended, are unsightly and will tend to unravel the work as a whole. In order to prevent such results, the loose threads need to be tied down or otherwise need to be secured.

The threads can be secured in one of two ways. The end of the loose thread nearest the mesh can be tied down and snipped in order to prevent travel of the thread through the mesh. Although this method of tie down and cutting of the loose thread is effective, it is very difficult to practice. Most loose threads tend to be of relatively short length such that only a highly skilled vascular surgeon could knot the thread. Furthermore, this method can result in an unsightly project and is ineffective when a large-spaced mesh is utilized.

The second method of thread securement is to position the loose thread underneath existing stitches within the needlework project. The stitches securely hold the thread in place and prevent unraveling. However, as the existing stitches are relatively tight, positioning of the loose threads thereunder can be quite challenging.

In order to accomplish this task, most individuals attempt to position the loose thread with the help of a needle that is used as a "lifter" of the threads. Such a method, inefficient and difficult at best, runs a strong risk of cutting existing stitches or mesh.

A device is needed to assist an individual in tying down loose threads in a needlework project. The device should be relatively quick and simple to use and should not cause any damage to the existing needlework. Ideally, such a device should be of relatively simple and inexpensive construction.

SUMMARY OF THE INVENTION

The thread positioner of the present invention meets the aforementioned needs in the art. The present invention provides a thread positioner that grabs a loose thread of a needlework project and positions the loose thread underneath existing stitching.

The thread positioner of the present invention comprises a guide loop that is inserted through one or more existing stitches on the needlework project with the end of the guide loop protruding beyond the target stitches. A thread grabber passes through the guide loop and grabs the loose thread. Once the thread is grabbed, the thread grabber is retracted from the guide loop depositing the loose thread between the edges of the guide loop. Once the loose thread is thus deposited, the guide loop itself, with loose thread in tow, is retracted from within the target stitch or stitches and thereby permanently depositing the loose thread within the stitches.

The thread positioner is quick and simple to use. The device does not damage the needlework or material and leaves the loose thread tied down with a neat and clean appearance.

The device is very simple and relatively inexpensive to construct.

BRIEF DESCRIPTION OF THE DRAWINGS

FIG. 1 is a a front elevation view of the thread positioner of the present invention.

FIG. 2 is a side elevation view of the thread positioner of the present invention.

FIG. 3 is an exploded view of the guide loop with a releasably attachable connection means.

FIG. 4 is a cutaway view of the guide means illustrated in FIG. 1.

FIG. 5 is a cutaway view of the guide means illustrated in FIG. 2.

Similar reference numerals refer to similar parts throughout the several views of the drawings.

DETAILED DESCRIPTION OF THE PREFERRED EMBODIMENT

Referring now to the drawings, it is seen that the thread positioner of the present invention, generally denoted by reference numeral 10, is comprised of a guide means having a guide loop 12. The guide loop 12 is a resilient member made from wire, plastic or other similar material. The guide loop 12 is attached to a finger grip 16 by any appropriate method. As seen in FIGS. 4 and 5, the finger grip 16 can have a hollow channel 20, with a first opening 22 and a second opening 24, disposed therein. The guide loop 12 is disposed and secured within the hollow channel 20 through the first opening 22. It is recognized that the guide loop 12 can be attached to the finger grip 16 by any other appropriate means. It is noted that while the finger grip 16 is illustrated as an ornamental heart, the finger grip 16 can be configured in any appropriate shape and design to facilitate holding of the finger grip 16 by a user.

A first keyhole 18 is disposable within the second opening for insertion of a chain or string (neither illustrated) therethrough. An optional second keyhole 28 is securable to the finger grip 16 at any appropriate point on the finger grip 16 including disposed within the first opening 22.

A thread grabber is comprised of a shaft having a proximal end 36 and a distal end 38, having a hook 40 thereon. The proximal end 36, which can be ornamentally designed, serves as a finger grip. An optional third keyhole 34 is attached to the end of the proximal end 36.

A connection means 32 connects the thread grabber to the finger grip 16 of the guide loop 12. The connection means 32 be any appropriate flexible or semi-flexible material such as the illustrated chain as well as string, an elongate piece of plastic, rubber, or neoprene, among others. The connection means 32 can be either releasably or securely attached to the finger grip 16 and can be either releasably or securely attached to the thread grabber. If the connection means 32 is releasably attached to the finger grip 16, any appropriate method can be employed to provide the releasable attachment. As an example, a clasp 30, located on the end of the connection means 32 can receive the optional second keyhole 28. If the connection means 32 is releasably attached to the thread grabber, any appropriate method can be employed to provide the releasable attachment including a clasp 30 receiving the optional third keyhole 34. Additionally, the connection means 32 can be retachably separable along its length.

In order to utilize the thread positioner 10, the guide loop 12 is inserted through the target stitch or stitches within which the loose thread will eventually be secured. The end of the guide loop 12 extends beyond the final stitch and terminates near the loose thread to be positioned and secured. The thread grabber is inserted through the guide loop 12. The hook 40 is used to grab the loose thread. Once so grabbed, the thread grabber, with the loose thread secured by the hook 40, is retracted with loose thread in tow from within the guide loop 12. The loose thread is now positioned within the guide loop 12. Thereafter, the guide loop 12 is withdrawn, with loose thread in tow, from the stitches. Once the guide loop 12 is fully withdrawn, the loose thread is securely positioned within the target stitches.

If the loose thread is found on the front side, as opposed to the back side, of the material, the device 10 is used to retrieve the loose thread to the back side where the loose thread can then be securely positioned as described above. In order to accomplish this task, the guide means is separated from the thread grabber. The guide loop 12 is positioned on the back side of the material and is pushed through the material so that the guide loop's end is located on the front side of the material proximate the loose thread. Thereafter, the thread grabber is inserted through the guide loop 12 and the hook 40 is used to grab the loose thread. The thread grabber is then retracted so that the loose thread is positioned within the guide loop 12 in the usual way. With the loose thread now positioned within the guide loop 12, the guide loop 12 is pulled out of the material pulling the loose thread to the back side of the material. The loose thread, now located at the back side of the material, is now ready for secure positioning within the stitching.

While the invention has been particularly shown and described with reference to an embodiment thereof, it will be understood by those skilled in the art that various changes in form and detail may be made without departing from the spirit and scope of the invention.

We claim:

1. A thread positioner comprising:

a finger grip;

a closed guide loop, having a pair of generally coextensive side members joined by a curved portion at one end and converging at a second end and attached to the finger grip at the second end; and a detachably connectable grabber means in connection with the finger grip for grabbing a loose thread and positioning the loose thread within the closed guide loop.

2. The device as in claim 1 wherein the grab means comprises:

a shaft; and a hook on the end of the shaft.

3. The device as in claim 2 wherein the shaft has a proximal end, defining a finger grip, and a distal end.

4. The device as in claim 1 to further include a connection means to connect the finger grip to the grabber means.

5. The device as in claim 4 wherein the connection means is flexible.

6. The device as in claim 4 wherein the connection means is semi-flexible.

7. The device as in claim 4 wherein the connection means comprises a chain.

8. The device as in claim 4 wherein the connection means is securely attached to the finger grip.

9. The device as in claim 4 wherein the connection means is releasably attached to the finger grip.

10. The device as in claim 9 to further include a keyhole, attached to the finger grip; and a clasp, attached to the connection means, for receiving the keyhole.

11. The device as in claim 4 wherein the connection means is securely attached to the grabber means.

12. The device as in claim 4 wherein the connection means is releasably attached to the grabber means.

13. The device as in claim 9 to further include a keyhole, attached to the grab means; and a clasp, attached to the connection means, for receiving the keyhole.

14. The device as in claim 4 to further include a keyhole, attached to the finger grip.

15. A method of grabbing a loose thread and positioning the thread within needlework comprising the steps of:

providing a guide means having a closed loop end portion;

providing a thread grabbing means attachable to the guide means;

inserting the thread guide means through one or more target stitches;

positioning the end portion of the guide means beyond a final stitch;

inserting the thread grabbing means through the guide means;

grabbing the loose thread with the thread grabbing means;

withdrawing the grabbing means and the loose thread through the guide means; and pulling the loose thread through the one or more target stitches and securing the loose thread therein.

16. The method as in claim 15 wherein the guide means comprises:

a finger grip; and wherein the closed loop has a pair of generally coextensive side members joined by a curved portion at one end and converging at a second end attached to the finger grip at the second end.

* * * * *